US012011106B2

(12) United States Patent
Huang

(10) Patent No.: US 12,011,106 B2
(45) Date of Patent: Jun. 18, 2024

(54) ENVIRONMENT-FRIENDLY CARRY DEVICE

(71) Applicant: OTA PACK INDUSTRY CO., LTD., Yuanlin (TW)

(72) Inventor: Chao-Ta Huang, Yuanlin (TW)

(73) Assignee: OTA PACK INDUSTRY CO., LTD., Yuanlin (TW)

( * ) Notice: Subject to any disclaimer, the term of this patent is extended or adjusted under 35 U.S.C. 154(b) by 296 days.

(21) Appl. No.: 17/566,092

(22) Filed: Dec. 30, 2021

(65) Prior Publication Data

US 2022/0202220 A1 Jun. 30, 2022

(30) Foreign Application Priority Data

Dec. 31, 2020 (TW) ..... 109217462

(51) Int. Cl.
*A47G 23/02* (2006.01)

(52) U.S. Cl.
CPC ..... *A47G 23/0216* (2013.01)

(58) Field of Classification Search
CPC ..... A47G 23/0216; A47G 23/0208; A47G 23/0266; A47G 2023/0283; A47G 2023/0291; B65D 2571/00456; B65D 71/42; B65D 71/44
See application file for complete search history.

(56) References Cited

U.S. PATENT DOCUMENTS

| | | | | | |
|---|---|---|---|---|---|
| 2,965,281 | A * | 12/1960 | Herrmann | A47G 23/0216 | D7/622 |
| 4,033,489 | A * | 7/1977 | Fowler | A47G 23/0208 | 294/159 |
| 5,743,389 | A * | 4/1998 | Cutler | B65D 71/44 | 229/932 |
| 6,047,852 | A * | 4/2000 | Evans | A47G 23/0216 | 229/404 |
| 9,932,160 | B2 * | 4/2018 | Smith | B65D 71/48 | |
| 2016/0309935 | A1 * | 10/2016 | Chuang | B65D 25/282 | |
| 2017/0027355 | A1 * | 2/2017 | Bateman | A47G 23/0216 | |
| 2018/0178961 | A1 * | 6/2018 | Choi | B65D 71/40 | |
| 2021/0163199 | A1 * | 6/2021 | Rattanapaibooncharoen | B65D 71/504 | |

* cited by examiner

*Primary Examiner* — Don M Anderson
(74) *Attorney, Agent, or Firm* — MUNCY, GEISSLER, OLDS & LOWE, P.C.

(57) ABSTRACT

An environment-friendly carry device is provided, including: a main body, including at least one through hole, the at least one through hole being configured for receiving and holding at least one object; at least one handle portion, connected with the main body and configured for gripping; and at least two wing portions, connected with the main body.

8 Claims, 6 Drawing Sheets

ENVIRONMENT-FRIENDLY CARRY DEVICE

BACKGROUND OF THE INVENTION

Field of the Invention

The present invention relates to an environment-friendly carry device.

Description of the Prior Art

In recent years, environmental awareness has risen, and the government has taken the lead in advocating environmental protection and implementing plastic restrictions. For example, it is forbidden to provide plastic bags for free. At the same time, people have spontaneously reused plastic bags and prepared environment-friendly bags to carry things. People often use plastic bags for carrying beverage. In limited uses to plastic and for environmental protection, various carry devices for beverages, such as those disclosed in TW M603003, TW M600735 and TW M599112, have been developed to replace plastic bags.

However, there are shortcomings of the conventional carry devices in the market. The environment-friendly carry device of the present invention provides a new type of carry device that is quite friendly to the environment, that provides at least one handle portion for easy and safe grip, and that can be reused many times, which reduces the overall usage of carry devices and reduces the burden of garbage on the global environment.

The present invention is, therefore, arisen to obviate or at least mitigate the above-mentioned disadvantages.

SUMMARY OF THE INVENTION

The main object of the present invention is to provide an environment-friendly carry device which has a simple structure and facilitates gripping.

To achieve the above and other objects, an environment-friendly carry device is provided, including: a main body, including at least one through hole, the at least one through hole being configured for receiving and holding at least one object; at least one handle portion, connected with the main body and configured for gripping; and at least two wing portions, connected with the main body.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
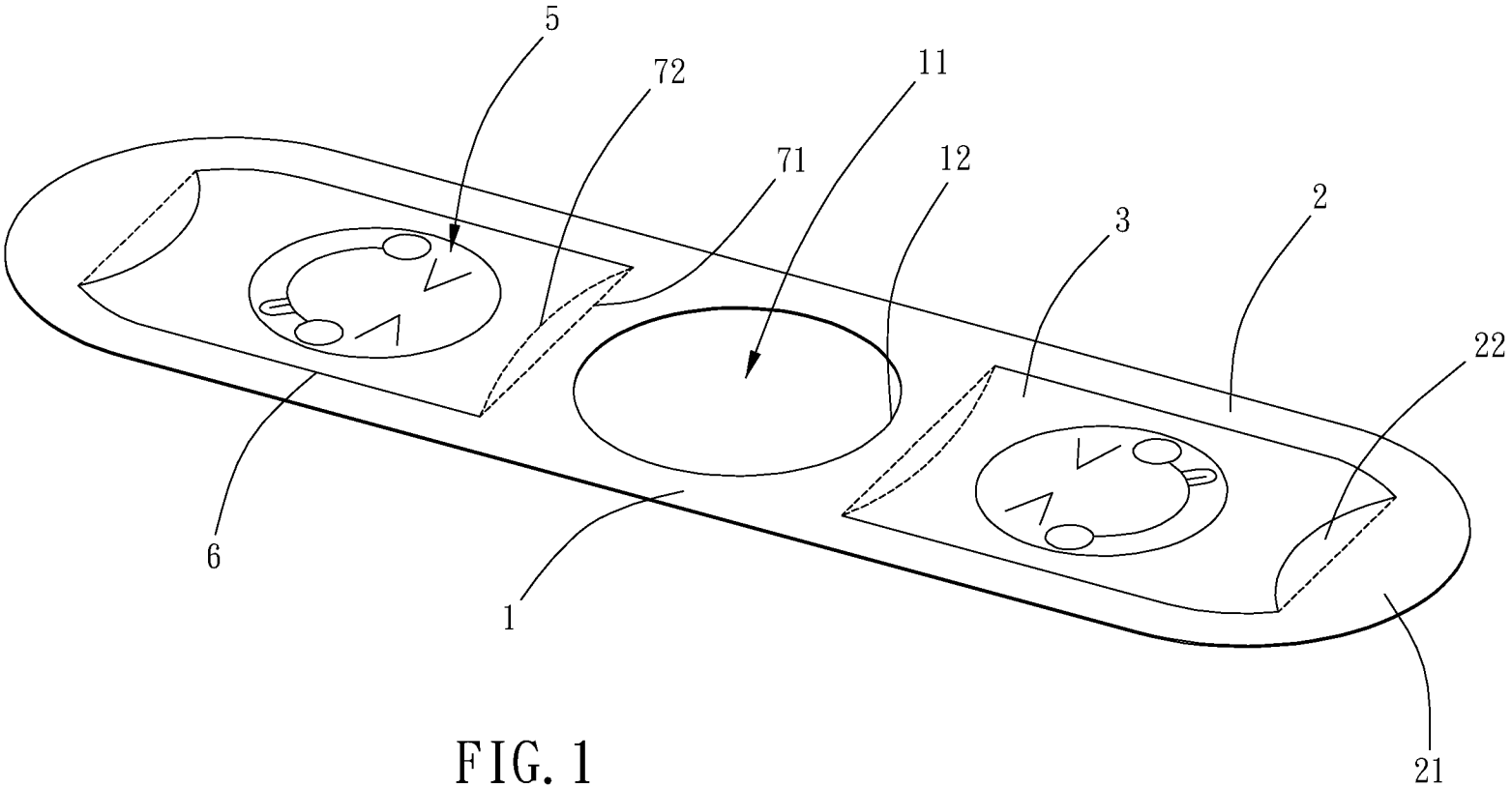
FIG. 1 is a stereogram of a preferable embodiment of the present invention.
Figure 2:
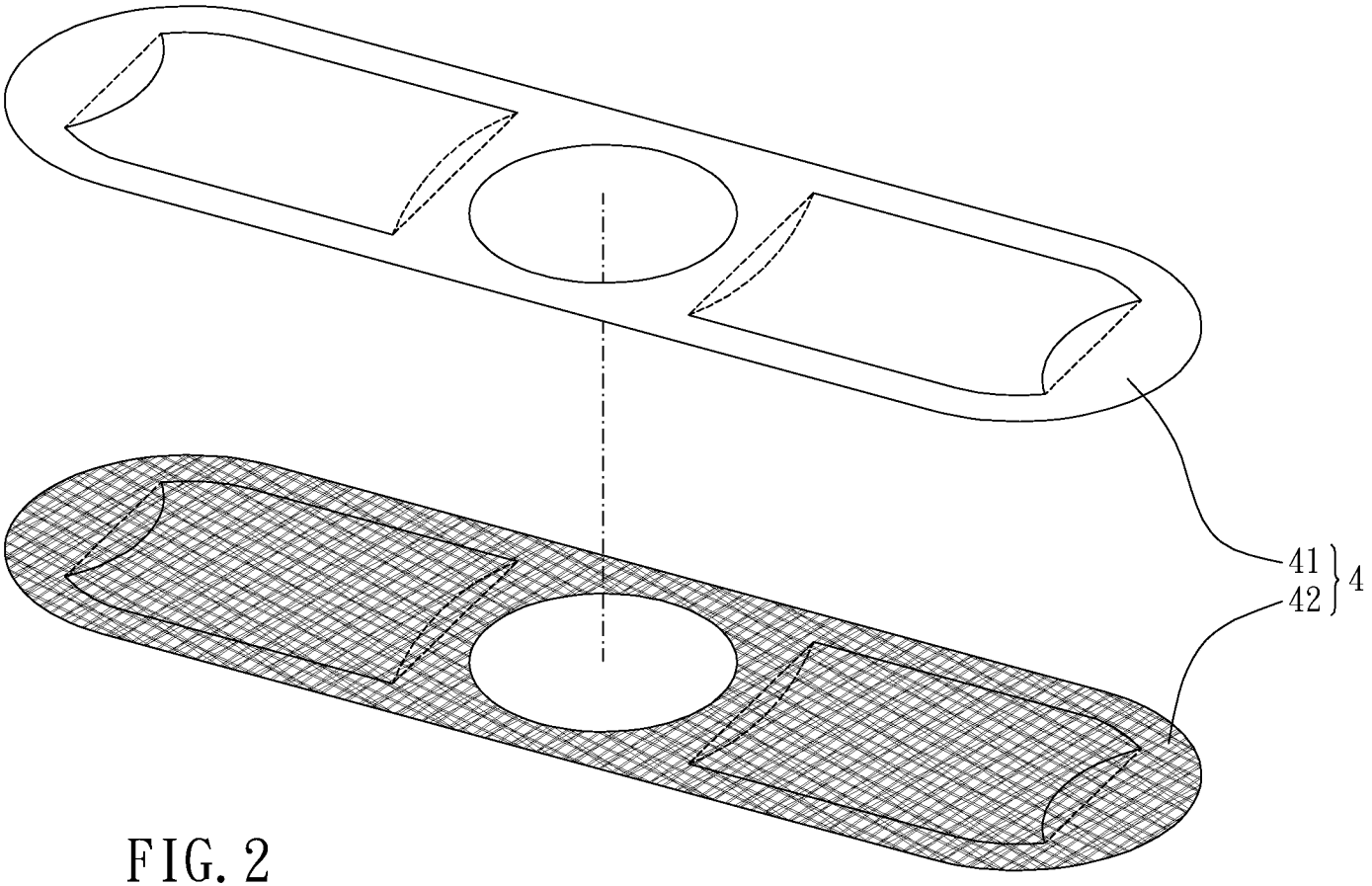
FIG. 2 is a breakdown drawing of a preferable embodiment of the present invention.
Figure 3:
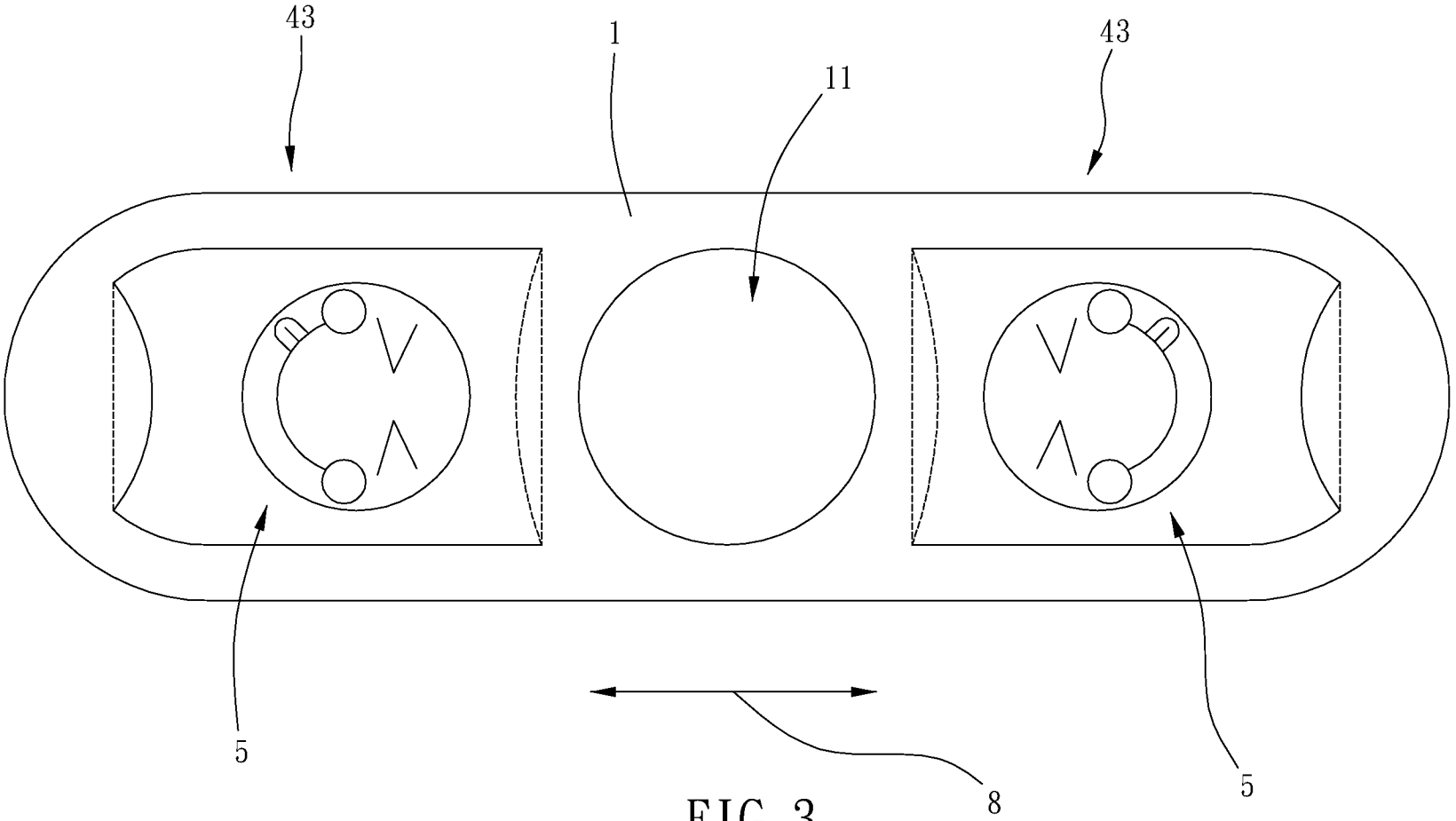
FIG. 3 is a top view of FIG. 1.
Figure 4:
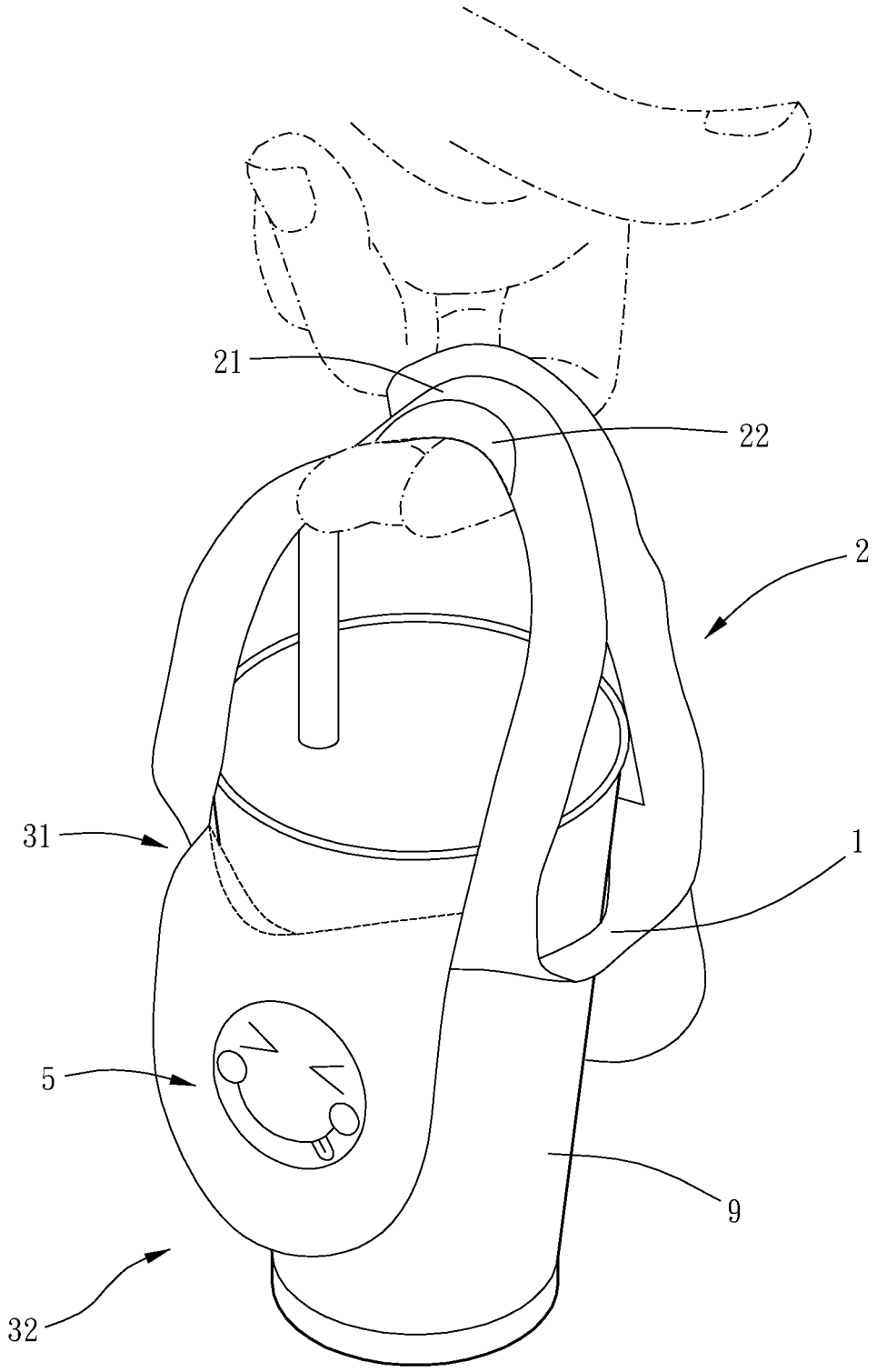
FIG. 4 is a drawing showing application of a preferable embodiment of the present invention.

Please refer to FIGS. 1 to 4 for a preferable embodiment of the present invention. An environment-friendly carry device 1 of the present invention includes a main body 1, at least one handle portion 2 and at least two wing portions 3.

The main body 1 includes at least one through hole 11, and the at least one through hole 11 is configured for receiving and holding at least one object 9 (such as beverage cup). The at least one handle portion 2 is connected with the main body 1 and configured for gripping or hanging.

The at least two wing portions 3 are connected with the main body 1 and configured for various uses. For example, at least one of the at least two wing portions 3 includes a pattern portion 5, such as advertising graphics, literature, trademark signs, slogans, etc.

Specifically, each of the at least two wing portions 3 includes a first end 31 and a second end 32, the first end 31 is connected to the main body 1, the second end 32 is a free end, the first end 31 includes a first fold line 71, and each of the at least two wing portions 3 is foldable about the first fold line 71 to cover at least a part of the at least one object 9. Whereby, when the at least one object 9 contains cold matters and there are water droplets on the outer surface, the user can hold each of the wing portions 3 at the outer side of the at least one object 9, which can prevent hands from getting wet; when the at least one object 9 contains hot matters, the user can hold each of the wing portions 3 at the outer side of the at least one object 9, which provides the function of heat insulation. Moreover, the wing portions 3 make the pattern portion 5 be located in a more eye-catching position.

Preferably, the first end 31 further includes a second fold line 72, at least a part of the second fold line 72 and the first fold line 71 are arranged in interval, and one of the second fold line 72 the at least two wing portions 3 is foldable about the second fold line 72, for covering the at least one object 9 well and being more stereoscopic. In this embodiment, the first fold line 71 is straight, the second fold line 72 is curved, and two ends of the second fold line 72 are connected with two ends of the first fold line 71, respectively, so that the wing portions 3 can be gapped from the main body 1.

The at least one handle portion 2 includes a grip portion 21 and an extending portion 22, the extending portion 22 is connected with and protrusive from the grip portion 21, and the extending portion 22 is foldable to overlap with at least a part of the grip portion 21 so that it provides good and comfortable gripping.

Preferably, the environment-friendly carry device is formed of one piece by cutting a sheet member 4, which is easy and quick to manufacture, convenient to transport and store and easy to assemble.

Specifically, the sheet member 4 includes a first layer 41 and a second layer 42 which are stacked, which provides sufficient structural strength for carrying and support the at least one object 9. Preferably, the first layer 41 is continuously flat, which is convenient to print or coat the pattern portion 5 on the first layer 41; the second layer 42 is in a woven web configuration so that it requires less raw material for producing the environment-friendly carry device with sufficient structural strength. In this embodiment, the first layer 41 is a layer of paper layer, polypropylene (PP) or non-woven fabric, and the second layer is a layer of polyethylene (PE), the second layer 42 is a layer of polyethylene so that it has excellent functions such as convenient printing, environmental protection, being recyclable, and/or being waterproof.

In this embodiment, the number of the at least one handle portion 2 is equivalent to the number of the at least two wing portions 3, the sheet member 4 includes the main body 1 and at least two arm portions 43, the at least two arm portions 43 are respectively connected with the main body 1, and each of the at least two arm portions 43 includes a cut line 6 defining one of the at least two wing portions 3 and one of the at least one handle portion 2.

In this embodiment, the cut line 6 is U-shaped, the at least two arm portions includes two arm portions 43, the at least one handle portion includes two handle portions 2, the at least two wing portions 3 includes two wing portions 3, each of the two wing portions 3 includes one of the pattern portion 5, and the two arm portions 43 are symmetrically arranged at two sides of the main body 1 a first direction 8, for balanced gripping and carrying. In the first direction 8, the wing portion 3 has a largest extent greater than a diametric dimension of the through hole 11, for sufficient coverage of the wing portion 3 to the at least one object 9, and for sufficient exhibition of the pattern portion 5. The at least one through hole may include one or more through holes 11, for carrying one or more objects. In this embodiment, the at least one through hole includes a single one through hole 11.

Preferably, the at least one through hole 11 is circular, which can support and hold the at least one object 9 well.

Preferably, in a direction perpendicular to the first direction 8, the single one through hole 11 is distanced from a periphery 12 of the main body 1 with a distance at least greater than 10 mm so that the main body 1 has a strong structure in use.

Figure 5:
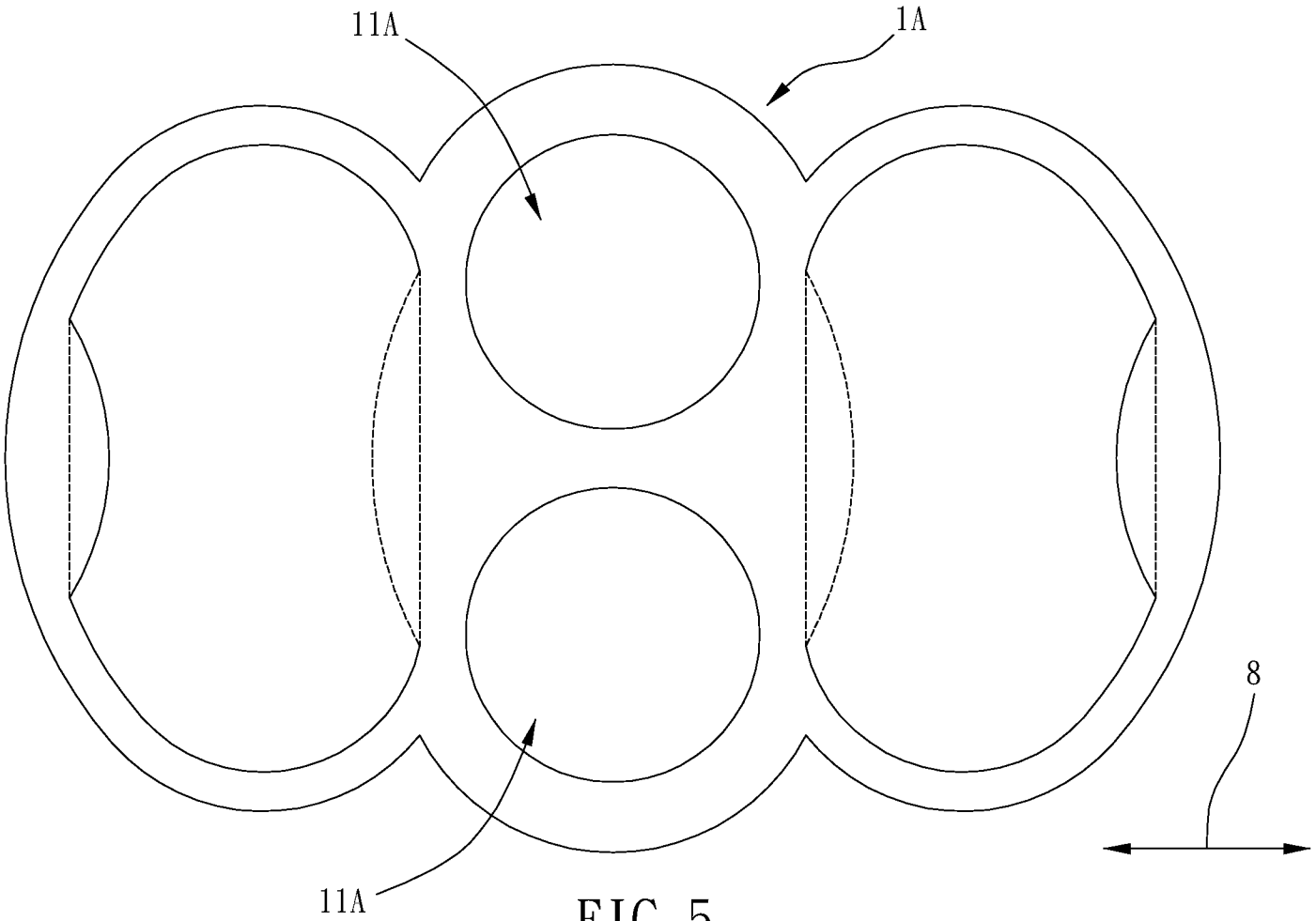
FIG. 5 is a top view of another preferable embodiment of the present invention.
Figure 6:
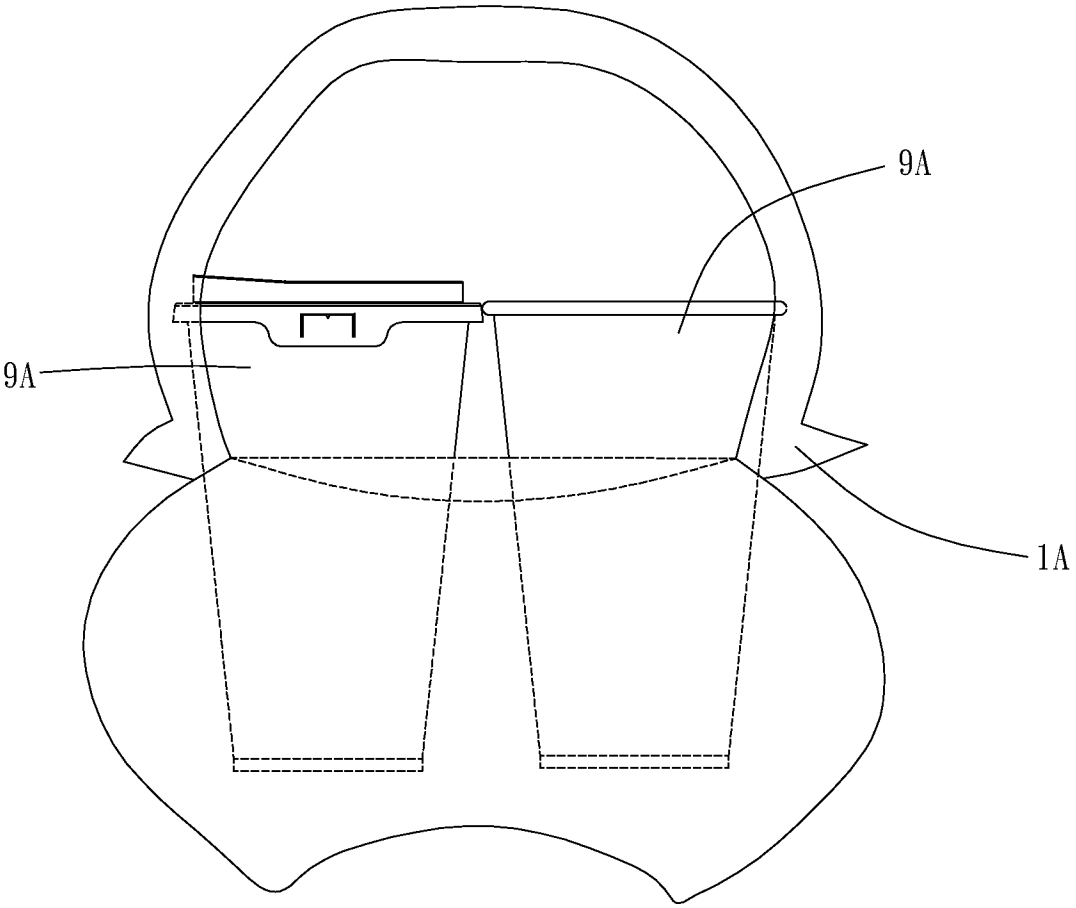
FIG. 6 is a drawing showing application of the another preferable embodiment of the present invention.

Please refer to FIGS. 5 and 6, in an alternative embodiment, the at least one through hole includes two through holes 11A so that the main body 1A can carry two objects 9A. Preferably, in a direction perpendicular to the first direction 8, there is a distance about 15 mm between the two through holes 11A, which enhances structural strength and permit the two objects 9A abut radially against each other when the two objects 9A is received in the two through holes 11A.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An environment-friendly carry device, comprising:

a main body, including at least one through hole, the at least one through hole being configured for receiving and holding at least one object;

at least one handle portion, connected with the main body and configured for gripping; and at least two wing portions, connected with the main body, wherein the first end further includes a second fold line, at least a part of the second fold line and the first fold line are arranged in interval, and one of the at least two wing portions is foldable about the second fold line.

2. An environment-friendly carry device, comprising:

a main body, including at least one through hole, the at least one through hole being configured for receiving and holding at least one object;

at least one handle portion, connected with the main body and configured for gripping; and at least two wing portions, connected with the main body, wherein each of the at least two wing portions includes a first end and a second end, the first end is connected to the main body, the second end is a free end, the first end includes a first fold line, and each of the at least two wing portions is foldable about the first fold line to cover at least a part of the at least one object, wherein the environment-friendly carry device is formed of one piece by cutting a sheet member, wherein the sheet member includes a first layer and a second layer which are stacked, wherein the first layer is a layer of paper layer, polypropylene (PP) or non-woven fabric, and the second layer is a layer of polyethylene (PE), and wherein the number of the at least one handle portion is equivalent to the number of the at least two wing portions, the sheet member includes the main body and at least two arm portions, the at least two arm portions are respectively connected with the main body, and each of the at least two arm portions includes a cut line defining one of the at least two wing portions and one of the at least one handle portion; the at least one handle portion includes a grip portion and an extending portion, the extending portion is connected with and protrusive from the grip portion, and the extending portion is foldable to overlap with at least a part of the grip portion; each of the at least two wing portions includes a first end and a second end, the first end is connected to the main body, the second end is a free end, the first end includes a first fold line, and each of the at least two wing portions is foldable about the first fold line to cover at least a part of the at least one object; the first end further includes a second fold line, at least a part of the second fold line and the first fold line are arranged in interval, and one of the at least two wing portions is foldable about the second fold line; the at least two arm portions includes two arm portions, the at least one handle portion includes two handle portions, the at least two wing portions includes two wing portions, and each of the at least two wing portions includes a pattern portion; the two arm portions are symmetrically arranged at two sides of the main body relative to a first direction; in the first direction, and each of the two wing portions has a largest extent greater than a diametric dimension of the through hole; the first layer is continuously flat, and the second layer is in a woven web configuration; the cut line is U-shaped; the first fold line is straight, the second fold line is curved, and two ends of the second fold line are connected with two ends of the first fold line, respectively; the at least one through hole includes a single one through hole, and the single one through hole is circular; in a direction perpendicular to the first direction, and the single one through hole is distanced from a periphery of the main body with a distance at least greater than 10 mm.

3. The environment-friendly carry device of claim 2, wherein the number of the at least one handle portion is equivalent to the number of the at least two wing portions, the sheet member includes the main body and at least two arm portions, the at least two arm portions are respectively connected with the main body, and each of the at least two arm portions includes a cut line defining one of the at least two wing portions and one of the at least one handle portion.

4. The environment-friendly carry device of claim 1, wherein at least one of the at least two wing portions includes a pattern portion.

5. The environment-friendly carry device of claim 1, wherein the at least one handle portion includes a grip portion and an extending portion, the extending portion is connected with and protrusive from the grip portion, and the extending portion is foldable to overlap with at least a part of the grip portion.

6. The environment-friendly carry device of claim 2, wherein at least one of the at least two wing portions includes a pattern portion.

7. The environment-friendly carry device of claim 2, wherein the at least one handle portion includes a grip portion and an extending portion, the extending portion is connected with and protrusive from the grip portion, and the extending portion is foldable to overlap with at least a part of the grip portion.

8. The environment-friendly carry device of claim 2, wherein each of the at least two wing portions includes a first end and a second end, the first end is connected to the main body, the second end is a free end, the first end includes a first fold line, and each of the at least two wing portions is foldable about the first fold line to cover at least a part of the at least one object.

* * * * *